US007004326B1

(12) United States Patent
Dai et al.

(10) Patent No.: US 7,004,326 B1
(45) Date of Patent: Feb. 28, 2006

(54) ARSENIDE DEPRESSION IN FLOTATION OF MULTI-SULFIDE MINERALS

(75) Inventors: Zongfu Dai, Mississauga (CA); Julie-Ann Arlene Garritsen, Burlington (CA); Peter Frederic Wells, Oakville (CA); Manqiu Xu, Mississauga (CA)

(73) Assignee: Inco Limited, Toronto (CA)

( * ) Notice: Subject to any disclaimer, the term of this patent is extended or adjusted under 35 U.S.C. 154(b) by 0 days.

(21) Appl. No.: 10/960,527

(22) Filed: Oct. 7, 2004

(51) Int. Cl.

| | |
|---|---|
| ***B03D 1/01*** | (2006.01) |
| ***B03D 1/018*** | (2006.01) |
| ***B03D 1/14*** | (2006.01) |
| ***B03D 1/02*** | (2006.01) |

(52) U.S. Cl. ..... 209/166; 209/167

(58) Field of Classification Search ..... 209/166, 209/167

See application file for complete search history.

(56) References Cited

U.S. PATENT DOCUMENTS

| | | | | | |
|---|---|---|---|---|---|
| 2,007,176 | A | * | 7/1935 | Brinker | 423/26 |
| 2,154,092 | A | * | 4/1939 | Hunt | 209/167 |
| 2,342,277 | A | * | 2/1944 | Herkenhoff | 209/167 |
| 2,512,669 | A | * | 6/1950 | Morrow | 209/167 |
| 2,805,936 | A | * | 9/1957 | Schaufelberger | 423/41 |
| 4,681,675 | A | * | 7/1987 | Bresson et al. | 209/167 |
| 4,904,374 | A | * | 2/1990 | Singer et al. | 209/166 |
| 5,074,993 | A | * | 12/1991 | Kerr et al. | 209/167 |
| 5,171,428 | A | * | 12/1992 | Beattie et al. | 209/166 |
| 5,411,148 | A | * | 5/1995 | Kelebek et al. | 209/166 |
| 5,992,640 | A | * | 11/1999 | Clark et al. | 209/166 |

FOREIGN PATENT DOCUMENTS

WO 98/08585 * 3/1998

OTHER PUBLICATIONS

D.A. Jackson et al., "Gersdorffite (NiAsS) chemical state properties and reactivity toward air and aerated, distilled water", pp. 890-900, American Mineralogist, vol. 88, 2003.*

B. Tapley, "The selective flotation of arsenopyrite from pyrite", pp. 1217-1220, Minerals Engineering, vol. 16, 2003, Elsevier.*

A.M. Abeidu et al., "Magnesia Mixture as a Regulator in the Separation of Pyrite from Chalcopyrite and Arsenopyrite", pp. 285-302, International Journal of Mineral Processing, vol. 6, 1980, Elsevier.*

S. Kelebek et al, "The effect of sodium metabisulfite and triethylenetetramine system on pentlandite—pyrrhotite separation", pp. 135-152, International Journal of Mineral Processing, vol. 57, 1999, Elsevier.*

W.T. Yen et al., "Selective Flotation Of Enargite And Chalcopyrite", Flotation —Kinetics and Modeling, Proceeding of 21st International Mineral Processing Conference, Rome, Jul. 23-27, 2000, (P. Massace, ed.).

* cited by examiner

*Primary Examiner*—Thomas M. Lithgow
(74) *Attorney, Agent, or Firm*—Edward A. Steen

(57) ABSTRACT

A mineral separation process includes wet-grinding the ore to liberation of minerals, oxidizing the slurry using air, hydrogen peroxide or other oxidants and floating the valuable minerals at a pH between about 9.0 and 10.0 with a xanthate as collector, and a combination of a polyamine and a sulfur containing species as depressants for arsenide minerals. This depressant suite effectively depresses the flotation of arsenide minerals with no effect on the flotation of the valuable minerals.

26 Claims, 5 Drawing Sheets

ARSENIDE DEPRESSION IN FLOTATION OF MULTI-SULFIDE MINERALS

FIELD AND BACKGROUND OF THE INVENTION

The present invention relates generally to the field of mineral separation and in particular to a flotation process for depressing arsenic minerals using the synergistic combination of a polyamine, a sulfur containing species, and oxidation.

The production of most metals proceeds in two steps. First, a metal compound is concentrated from an ore, which is mostly an oxide or a sulfide. Second, the metal concentrate is smelted and refined.

The first step in producing metals is breaking apart the ore by crushing and grinding, and separating particles of metal minerals from the gangue. Gangue is a general term for valueless minerals which are mined together with the valuable minerals.

The separation of a metal mineral from the gangue is most commonly achieved by a process called flotation. The mineral particles are suspended in a fluid in a tank under agitation. Air is forced or sucked into the suspension and broken into air bubbles. The valuable metal mineral particles become attached to the air bubbles and float (hence the name "flotation") to the surface, forming a froth, which can be skimmed off. The gangue particles are not attached to the air bubbles and are discharged at the bottom of the tank.

Complete selectivity with respect to the separation of the individual minerals is impossible to achieve and often impure concentrates are produced.

It is known to add other chemical reagents to improve the selectivity of the separation process. One class of such reagents are the so-called depressing agents known to reduce the flotation rate of gangue minerals. Depressants affect the flotation process by rendering the unwanted mineral hydrophilic (i.e. water wettable), thus reducing the possibility of the unwanted mineral being floated simultaneously with those substances which are to be concentrated in the froth.

The concentrates need further processing or refinement in subsequent treatment steps to extract metals by high temperatures or chemical processes. Roasting, converting and smelting remove iron, sulfur and other impurities. The ore is heated in oxygen or air. The sulfur combines with oxygen and is blown off as gas. The remaining metal oxide must be further refined and purified.

Arsenic containing minerals are sometimes found in close association with base and precious metal minerals and, as a result, the co-mining of arsenic with metal minerals is inevitable. Mines may produce tailings with high residual arsenic concentrations due to the presence of arsenic in the ore. Mining of arsenic-bearing ores with the consequent oxidation of sulfides and release of metals and metalloids produces considerable contamination potential. Arsenic can be a by-product of smelters and coal or waste combustion.

If arsenic minerals are floated with metal minerals into the concentrates, they will be carried over to the subsequent pyrometallurgical processes. This creates two issues: smelters may constitute a major source of arsenic emissions from operations which pyrometallurgically treat sulfide concentrates containing arsenic. This is a major environmental concern. The other is the detrimental effect of arsenic on the metallurgical performance of the pyrometallurgical processes (Jackson, Nesbitt, Scaini, Dugal and Bancroft, *Gersdorffite (NiAsS) chemical state properties and reactivity toward air and aerated, distilled water*, American Mineralogist, vol. 88, pp. 890–900, 2003). It is often important that arsenic minerals are depressed during flotation of metal minerals so that the former are not carried over to the pyrometallurgical processes. This requires effective arsenic depressants to be added during flotation.

Nickel mining is particularly affected by high arsenic content. Nickel occurs in a number of minerals; the most economically important being pentlandite (nickel-iron sulfide) while violarite, millerite and garnierite (nickel-magnesium silicate) are also of importance. Pentlandite almost always occurs with much larger quantities of pyrrhotite ($Fe_7S_8$) which may contain a small fraction (up to 1%) of nickel but every effort is made to reject this mineral to tailings. Nickel is obtained commercially from pentlandite of the Sudbury region in Ontario, which produces about 30% of the world's supply of nickel. In Sudbury, nickel and copper sulfide minerals are concentrated by the flotation process into a Cu—Ni bulk concentrate, then smelted and converted to give sulfur dioxide, fayalite (iron silicate) slag and a Cu—Ni matte. The two metals are then separated from each other using the matte separation process. Mineral separation of Ni—Cu ores from the Sudbury region is discussed in greater detail in U.S. Pat. No. 5,411,148.

Arsenic occurs in various mineral forms, such as arsenides in sulfide minerals and as arsenate. One of the most common arsenic containing minerals is arsenopyrite (FeAsS). In the weathering of sulfides, arsenic can be oxidized to arsenite and arsenate. Arsenic oxide is also formed as a by-product of copper, lead and nickel smelting. The toxic nature of arsenic and its compounds presents a large concern for the environment. It has been found that certain ore bodies in the mines of the Sudbury region have arsenic content up to 200 times the normal content. Blending the ore into the feed to the mill has, at times, resulted in an increase in arsenic content of the Cu—Ni bulk concentrate to a level that significantly affects smelters and, more importantly, the efficiency of Cu—Ni separation in the matte separation plant. In the Sudbury region, the arsenic mainly occurs in a sulfide mineral with nickel called gersdorffite (NiAsS), with a small amount being in the form of cobaltite (CoAsS).

It is known in the prior art to use oxidation in combination with a magnesium chloride ($MgCl_2.6H_2O$), ammonium chloride ($NH_4Cl$) and ammonium hydroxide ($NH_4OH$) reagent (MM) as a depressant for arsenic-containing minerals during flotation of base and precious metal sulfides (Abeidu and Almahdy, *Magnesia Mixture as a Regulator in the Separation of Pyrite from Chalcopyrite and Arsenpyrite*, International Journal of Mineral Processing, vol. 6, pp. 285–302, 1980; Yen and Tajadod, *Selective Flotation of Enargite and Chalcoyrite*, Flotation Kinetics and Modelling, pp. B8a49–B8a55, 2000; Tapley and Yan, *The Selective Flotation of Arsenopyrite from Pyrite*, Minerals Engineering, vol. 16, pp. 1217–1220, 2003). However in the case of ores containing pyrrhotite as a gangue sulfide, the oxidation step results in the activation of pyrrhotite flotation and consequently a low grade concentrate of the valuable metal.

Depression of pyrrhotite during the flotation of Ni/Cu minerals has been achieved by using polyamines such as ethylene diamine (EDA), diethylenetetramine (DETA) and triethylenetetramine (TETA) as described in U.S. Pat. No. 5,074,993, or in combination with sodium sulfite or other sulfoxy species with sulfur valence less than 6 as described in U.S. Pat. No. 5,411,148.

WO 98/0858 teaches that TETA may be used against a large array of minerals including arsenides in a leaching process. A two-component, aqueous chemical leaching solution is taught, comprising any suitable oxidizing agent such as hydrogen peroxide, and any suitable chelating agent such as TETA. However, the use of TETA in a process of flotation and depression of NiAsS is not disclosed.

U.S. Pat. No. 4,681,675 discloses flotation utilizing 3-hydroxytrimethylene sulfides as depressants for iron, nickel, copper, lead, and/or zinc minerals, such as niccolite (NiAs) and tennantite ($(Cu,Fe)_{12}As_4S_{13}$).

U.S. Pat. No. 2,805,936 teaches autoclave leaching of non-ferrous metals, particularly nickel and arsenic using nitric acid.

There is a general need in the field of metal recovery for depressing arsenic content. There is also a particular need in the fields of nickel and copper mining for a process of depressing pyrrhotite and arsenic while producing a high grade concentrate of the desired valuable nickel and copper metal such as pentlandite (FeNiS) and chalcopyrite ($CuFeS_2$).

SUMMARY OF THE INVENTION

It is an object of the present invention to provide a depressing agent for depressing unwanted arsenic in a variety of ores.

It is a further object of the present invention to provide a depressing agent for depressing pyrrhotite and arsenic in nickel and copper mining in particular.

Accordingly, a polyamine-sodium sulfite combination can be used not only to depress pyrrhotite but also to depress arsenic minerals, and this effect is more pronounced if the pulp is oxidized prior to the addition of the polyamine-sodium sulfite reagent combination.

The process for depressing arsenic in general, and depressing pyrrhotite and arsenic minerals particularly in nickel and copper mining includes the steps of wet-grinding the ore to liberation of minerals, oxidizing the slurry using an oxidant, and floating the valuable minerals at a pH between about 9.0 and 10.0 with a collector, and the combination of polyamine and a sulfur containing species as depressants for arsenide minerals. This depressant suite effectively depresses the flotation of arsenide minerals with minimal effect on the valuable minerals. The polyamine is preferably TETA. The oxidant is preferably air or hydrogen peroxide. The sulfur containing species is preferably sodium sulfite. The collector is preferably a xanthate.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1A:
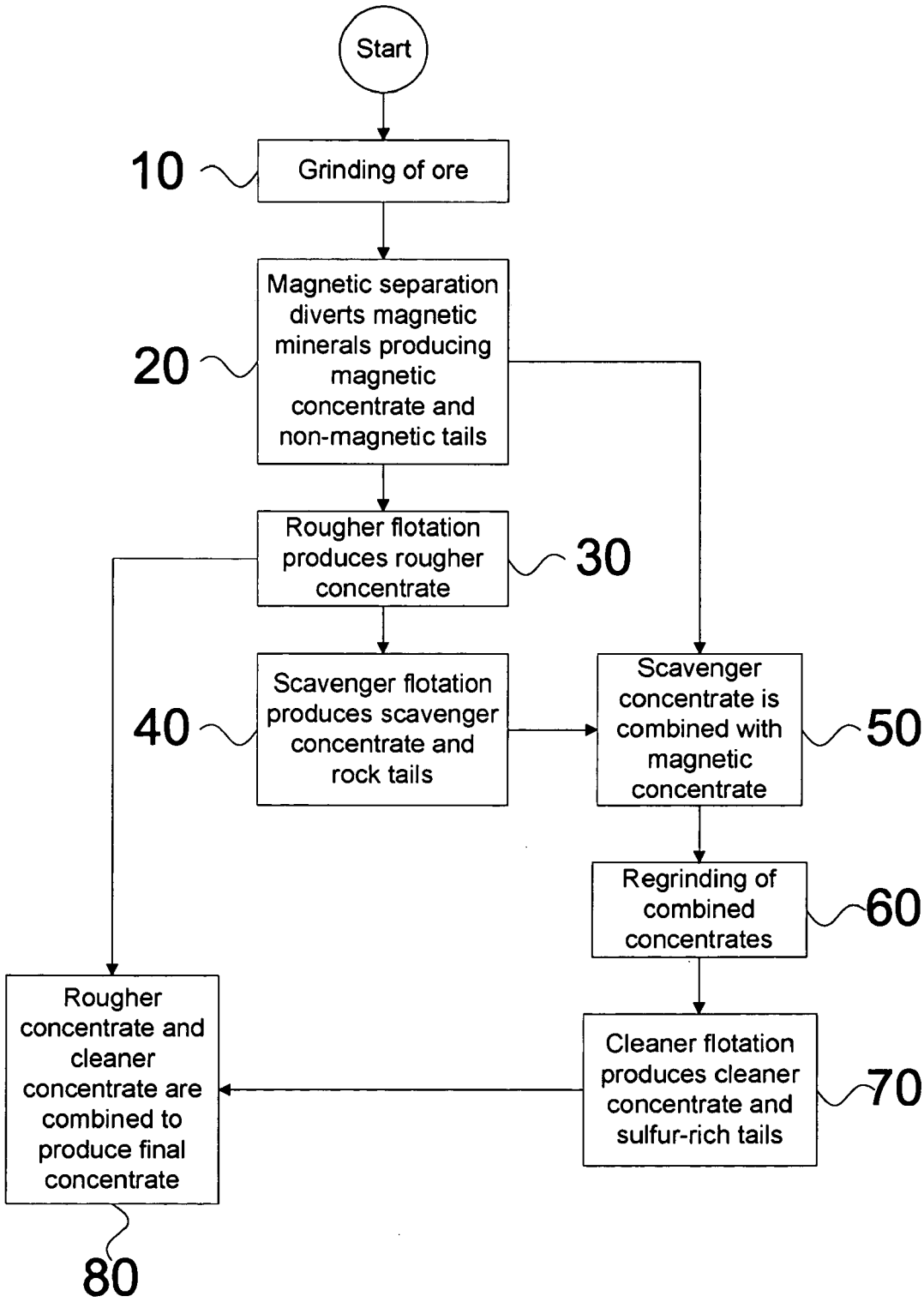
FIG. 1*a* is a flow diagram of the general steps for mineral recovery.

A preferred embodiment of the process of the present invention for depressing arsenide in ore comprises the following steps. The preposition "about" before one or more values shall be applicable to each value unless indicated to the contrary.

The first step comprises wet-grinding ore to liberation of minerals thus producing a slurry. The temperature of the slurry is preferably between about 5° and 35° C. The slurry contains about 20% to 45% solids by weight.

The second step comprises adjusting the slurry pH using a pH regulator. The pH is preferably between about 9.0 and 10.0. The pH regulator is preferably lime.

The third step comprises oxidizing the slurry using an oxidant. The oxidant is preferably air or hydrogen peroxide.

The fourth step comprises conditioning the slurry with a polyamine and sulfur containing species combination as depressants for arsenide minerals. The polyamine is preferably TETA. The sulfur containing species is preferably sodium sulfite.

The final step comprises adding a collector in an effective dosage and a frother in an effective dosage to the slurry to float the valuable minerals. The collector is preferably a xanthate such as for example potassium amyl xanthate. The frother is preferably polypropylene glycol methyl ether such as Dowfroth® 250C commercially available from Dow Chemical Co.

An effective dosage of collector is determined on a case-by-case basis, and understood by those skilled in the art to be a function of the amount of material to be floated and the fineness of grind. The dosage should be higher if the amount of target/valuable minerals contained in the ore is higher. The dosage should be higher if the grinding sizes are smaller. A normal range would be a minimum of about 10 g/tonne of ore to perhaps about 125 g/tonne of ore in cases where a substantial portion of the feed mass is to be recovered into the concentrate.

An effective dosage of frother is also determined on a case-by-case basis and is understood by one skilled in the art to be a function of the pH and ionic strength of the aqueous phase, and the mass of material to be recovered by flotation. Typical levels would be between about 10 and 60 grams/tonne.

The ratio of the polyamime to sulfur containing species ranges from about 1:1 to 1:8, and most preferably from about 1:1 to 1:4.

Although the polyamine of the present invention is preferably TETA, it can be any other suitable polyamine containing —N—C≡C—N-configuration such as ethylene diamine (EDA), 1,3-diaminopropane (DAP), (2-aminoethyl)-2-aminoethanol (AEAE), histidine, or polyethylenepolyamines such as diethylenetetramine (DETA) and triethylenetetramine (TETA). The polyamine can also be any other polyethylenepolyamine in which the number of ethyleneamine units is equal to or greater than that in diethylenetriamine.

Suitable sulfur containing species include thiosulfate, sulfides including sodium sulfide, ammonium sulfide, barium sulfide, hydrosulfides and polysulfides, sulfites including metabisulfites and hydrosulfites such as sodium metabisulfite and sodium hydrosulfite, dithionates and tetrathionates, calcium polysulfide and finally, sulfur dioxide and selected mixtures of the above. The cationic part, if any, of the above compounds may consist of but is not limited to hydrogen, sodium, potassium, ammonium, calcium, and barium. These are cited here only as examples since the success of the current process is not limited to these specific citations which are merely intended to serve for the purposes of process demonstration.

The calcium polysulfide used in the current invention may be freshly prepared as follows. Elemental sulfur is added to a container having sufficient amount of water which is saturated with lime ($Ca(OH)_2$) present in excess amount. The contents are stirred for an extended period at room temperature for the dissolution of sulfur in the highly alkaline medium. The period of preparation may be shortened by heating the contents. After the color of the solution turns to deep yellow, the excess solids may be filtered off, if desired, prior to the direct addition of the solution into the flotation cell in an effective dosage. For use in the bench scale tests, the preparation of this solution may be carried out in a 1 liter flask while bubbling nitrogen gas through it.

The sulfur-containing reagents, if desired, may be added directly into the flotation cell in solid or gas form to exploit their full strength. The dosages required range from about 0.05 to 3.00 kg/tonne depending on the feed to be treated. In addition to sodium sulfide, the use of barium sulfide (black ash) or ammonium sulfide produces the required conditioning effect on pyrrhotite. These sulfides are used in combination with various sulfites (e.g. sodium metabisulfite). In using some of these sulfites or sulfur dioxide, the pH of pulp decreases. The pH may drop to a value as low as about 6.5 to 7. In the preferred embodiment of the invention, the flotation pH should be between about 9 and 10 obtained by subsequent or simultaneous addition of an alkali.

Although the preferred oxidant of the present invention is air or hydrogen peroxide, other suitable oxidants may include permanganate, oxygen or any other oxidants having the same or higher oxidation potential than air.

In addition to xanthates, the collector of the present invention may be phosphine-based compounds or dithiophosphonates, alkyldiphosphates, thionocarbamates, thiourea or any other conventional sulfhydryl collectors.

The steps for physically recovering a final concentrate of minerals in general are shown in FIG. 1*a*. First, the ore is ground in step 10. In step 20, magnetic separation diverts magnetic minerals producing magnetic concentrate and non-magnetic tails. Rougher concentrate is produced from rougher flotation in step 30. In step 40, scavenger flotation produces scavenger concentrate and rock tails. The scavenger concentrate is combined with the magnetic concentrate in step 50. The combination of the scavenger and magnetic concentrates is reground in step 60. Cleaner flotation produces cleaner concentrate and sulfur-rich tails. In step 80, the rougher concentrate produced form step 30 and the cleaner concentrate produced in step 70 are combined to produce the final concentrate recovered.

In another embodiment of the invention concerning nickel and copper recovery in particular, the depressant of the present invention effectively depresses the flotation of both arsenide minerals and pyrrhotite with minimal effect on chalcopyrite or pentlandite flotation. The process for depressing includes the steps of wet-grinding the ore into a slurry which typically contains pentlandite, chalcopyrite, pyrrhotite, gersdorffite, cobaltite, niccolite, and siliceous gangue materials, adjusting the pH of the slurry from about 9 to 10, providing an oxidizing environment to the slurry, adding a reagent suite such as TETA and sodium sulfite, and adding a collector and a frother at appropriate dosages to the slurry to float the copper sulfide and nickel sulfide minerals. The ratio of TETA to sodium sulfite by weight is most preferably between 1:2 and 1:4 by mass.

As a result of the process, arsenide minerals such as gersdorffite, niccolite, and cobaltite are depressed and useful nickel and copper metals in pentlandite and chalcopyrite are recovered.

Figure 1B:
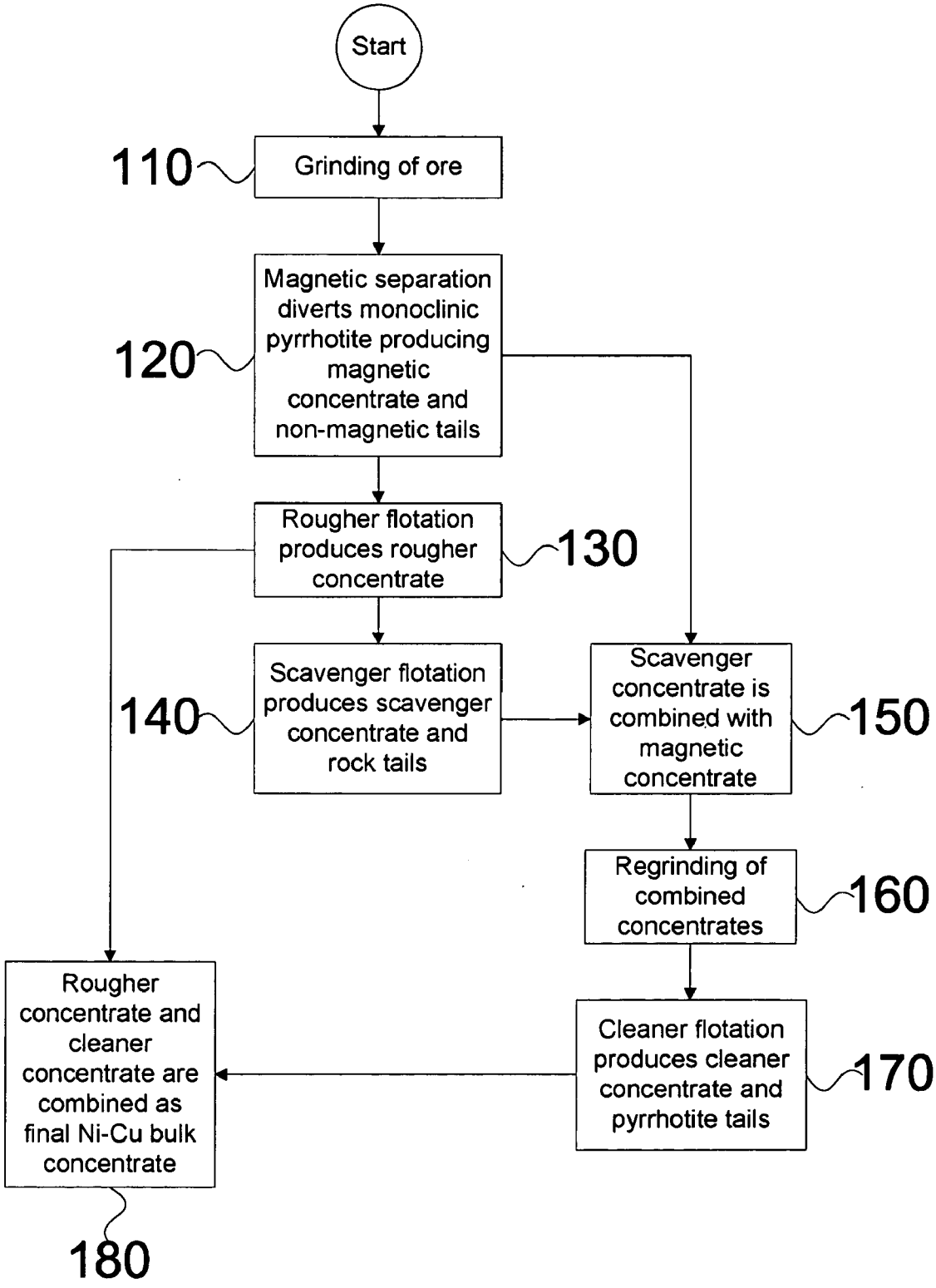
FIG. 1*b* is a flow diagram of the steps for recovering final nickel and copper bulk concentrate.

The steps for physically recovering final nickel and copper bulk concentrate are shown in FIG. 1*b*. In step 110, the ore is ground. In step 120, magnetic separation diverts monoclinic pyrrhotite and produces magnetic concentrate and non-magnetic tails. In step 130, rougher flotation produces rougher concentrates. Scavenger flotation produces scavenger concentrate and rock tails in step 140. The scavenger concentrate is combined with magnetic concentrate in step 150. In step 160, the combination of the scavenger and magnetic concentrates is reground. Cleaner flotation produces cleaner concentrate and pyrrhotite tails in step 170. Finally, in step 180, the rougher concentrate and cleaner concentrate are combined as final copper nickel bulk concentrate.

An example of the superior results obtained with the synergistic oxidation/TETA/sodium sulfite preferred combination is shown below. A typical high arsenic nickel-copper ore from the Sudbury basin containing 1.2% Cu, 2.4% Ni, 16.6% S and 0.06%. As was ground to a $P_{80}$ of 106 microns at 65% solids with the pulp adjusted to pH 9.5 with lime. The pulp was then diluted to 40% solids in a 2.2 liter laboratory Denver flotation cell while maintaining pH 9.5 with lime. A magnetic separation to reject part of the pyrrhotite was conducted before the slurry was oxidized for 30 minutes with air. TETA and sodium sulfite were then added prior to addition of potassium amyl xanthate and Dowfroth® 250C for flotation of a rougher concentrate. A scavenger concentrate was then collected at pH 9.5 using additional xanthate and frother. The scavenger concentrate and magnetic concentrate were combined and reground to 85% passing 38 microns and cleaned in a 1.1 liter Denver cell using the reagent combinations according to Table 1 below. The rougher concentrates and cleaner concentrates were combined as the final Cu—Ni bulk concentrate.

TABLE 1

| Description | Rougher Aeration (min) | Rougher TETA/sulfite (g/t) | Cleaner Aeration (min) | Cleaner TETA/sulfite (g/t) | Cleaner MAA (g/t) |
|---|---|---|---|---|---|
| ◇ Baseline (no aeration, TETA/sulfite or MAA) | 0 | 0 | 0 | 0 | 0 |
| ◆ Aeration/TETA/sulfite in rougher only | 30 | 150/300 | 0 | 0 | 0 |
| Δ Aeration/TETA/sulfite in rougher, TETA/sulfite in cleaner | 30 | 150/300 | 0 | 100/200 | 0 |
| ▲ Aeration/TETA/sulfite in rougher, Aeration/TETA/sulfite in cleaner | 30 | 150/300 | 30 | 100/200 | 0 |
| ⬯ Aeration/TETA/sulfite in rougher, MAA in cleaner | 30 | 150/300 | 0 | 0 | 300 |
| ⬮ Aeration/TETA/sulfite in rougher, Aeration/MAA in cleaner | 30 | 150/300 | 30 | 0 | 300 |
| □ Aeration/TETA/sulfite in rougher, TETA/sulfite + MAA | 30 | 150/300 | 0 | 100/200 | 300 |
| ▮ Aeration/TETA/sulfite in rougher, Aeration/TETA/sulfite + MAA in cleaner | 30 | 150/300 | 30 | 100/200 | 300 |

Figure 2A:
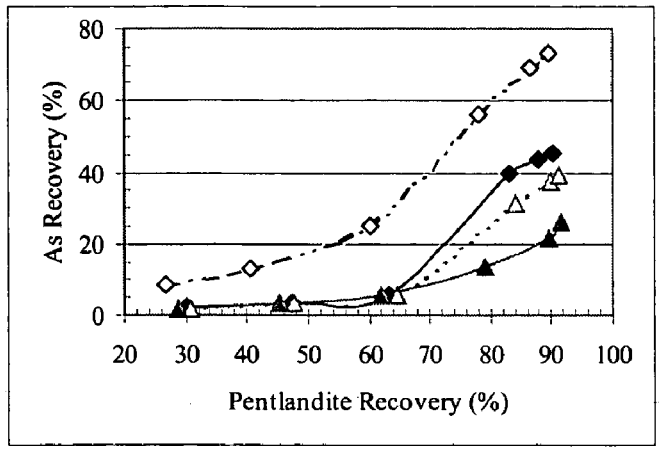
FIG. 2*a* is a graph plotting the effect of the TETA/sulfite reagent combination on arsenic recovery against pentlandite recovery during flotation of a Sudbury area ore.
Figure 2B:
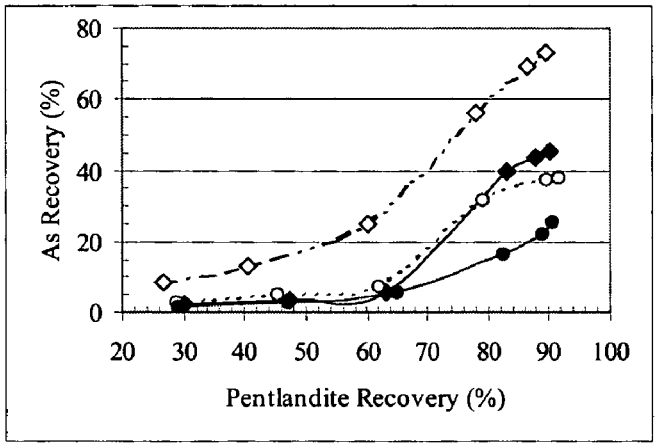
FIG. 2*b* is a graph plotting the effect of MM on arsenic recovery against pentlandite recovery during flotation of a Sudbury area ore.
Figure 2C:
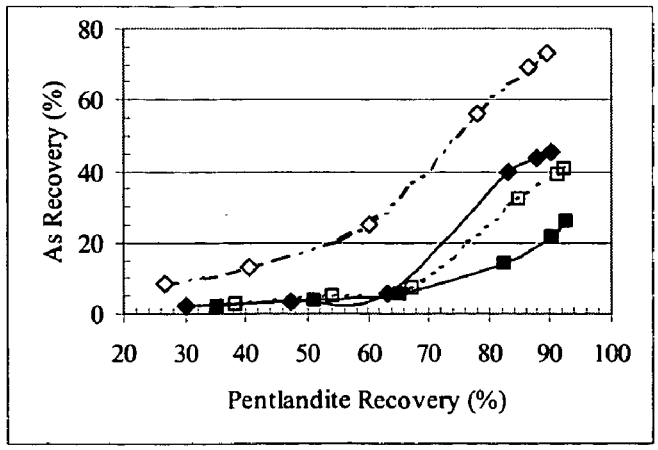
FIG. 2*c* is a graph plotting arsenic recovery against pentlandite recovery during flotation of a Sudbury area ore when both TETA/sulfite and MM are added.

The plotted lines in FIGS. 2*a*–2*c* are identified in the description section of Table 1. As shown in FIGS. 2*a*–2*c*, both the MAA and TETA/sulfite reagent combinations give good depression of arsenic minerals after pulp oxidation. FIG. 2*a* shows that aeration prior to TETA/sulfite addition enhances the effectiveness of this reagent combination on arsenic depression. FIG. 2*b* shows that aeration prior to MAA addition enhances its effectiveness on arsenic depression. A comparison of the graph in FIG. 2*c* with FIG. 2*a* and FIG. 2*b* indicates that combined use of these two reagent suites does not generate better metallurgical results than when either reagent suite is used alone.

Figure 3A:
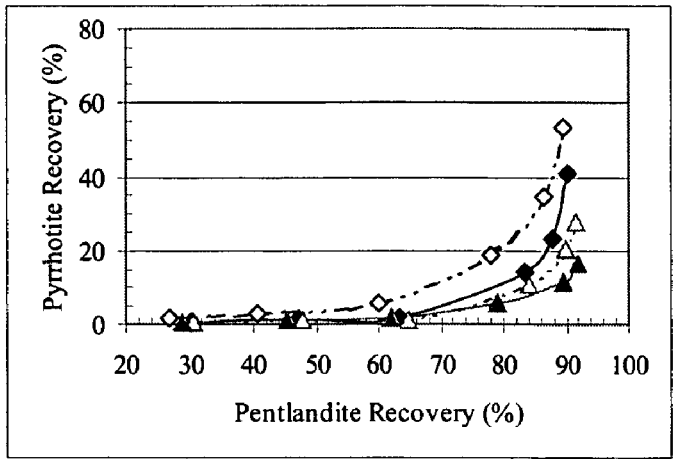
FIG. 3*a* is a graph plotting the effect of the TETA/sulfite reagent combination on pyrrhotite recovery against pentlandite recovery during flotation of a Sudbury area ore.
Figure 3B:
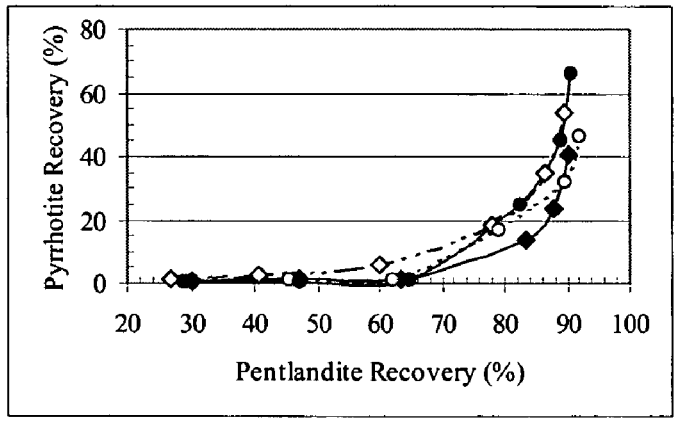
FIG. 3*b* is a graph plotting the effect of MAA on pyrrhotite recovery against pentlandite recovery during flotation of a Sudbury area ore.
Figure 3C:
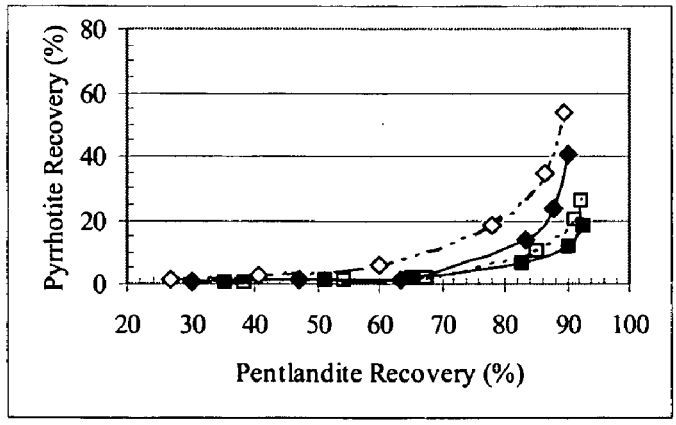
FIG. 3*c* is a graph plotting pyrrhotite recovery against pentlandite recovery during flotation of a Sudbury area ore when both TETA/sulfite and MM are added.

The plotted lines in FIGS. 3*a*–3*c* are identified in the description section of Table 1. FIGS. 3*a*–3*c* show that TETA/sulfite has strong depression on pyrrhotite flotation, but addition of MAA slightly promoted pyrrhotite flotation. FIG. 3*a* shows that aeration prior to TETA/sulfite addition enhances the effectiveness of this reagent combination on pyrrhotite depression. FIG. 3*b* shows that addition of MAA promotes pyrrhotite flotation. A comparison of the graph in FIG. 3*c* with FIG. 3*a* indicates that the effectiveness of TETA/sulfite on pyrrhotite depression remains the same whether MAA is added or not.

Figure 4A:
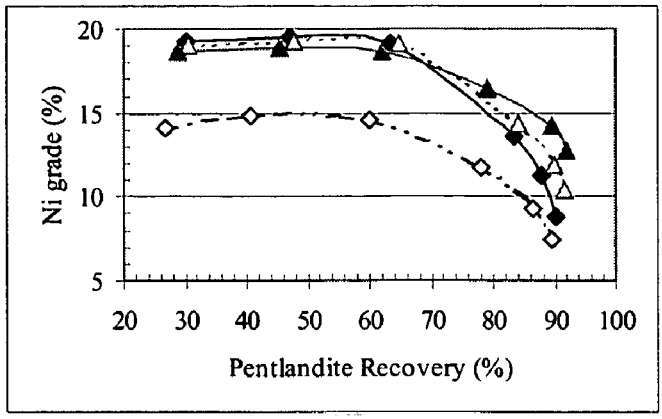
FIG. 4*a* is a graph plotting the effect of the TETA/sulfite reagent combination on nickel grade against pentlandite recovery during flotation of a Sudbury area ore.
Figure 4B:
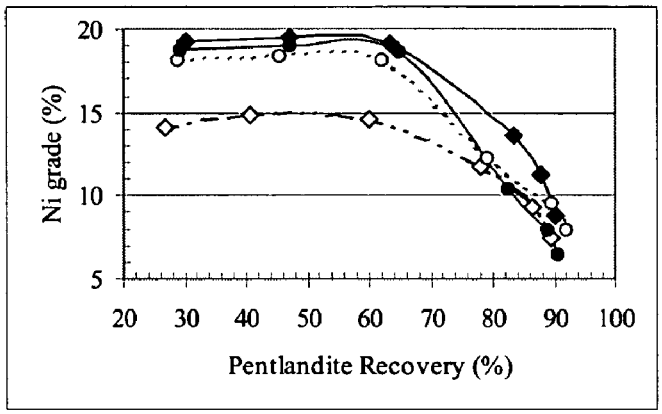
FIG. 4*b* is a graph plotting the effect of MM on nickel grade against pentlandite recovery during flotation of a Sudbury area ore.
Figure 4C:
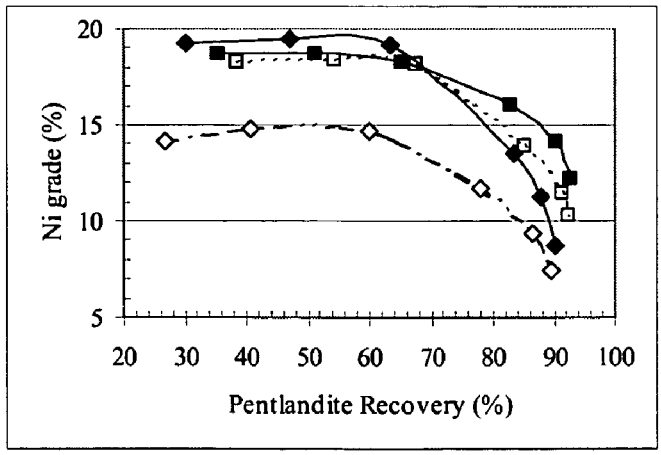
FIG. 4*c* is a graph plotting nickel grade against pentlandite recovery during flotation of a Sudbury area ore when both TETA/sulfite and MM are added.

The plotted lines in FIGS. 4*a*–4*c* are identified in the description section of Table 1. The nickel grade/pentlandite recovery relationship, which would be indicative of the concentrate grade obtainable, is clearly much better for the TETA/sulfite combination than for MAA as shown in FIGS. 4*a*–4*c*. FIG. 4*a* shows that due to the depression of pyrrhotite flotation by TETA/sulfite, nickel grade is increased compared to the baseline. Since MAA slightly promotes pyrrhotite flotation, the final nickel grade is lower than the baseline in FIG. 4*b*. A comparison of the graph in FIG. 4*c* with FIG. 4*a* indicates that the effectiveness of TETA/sulfite combination on pyrrhotite depression and thus on nickel grade remains the same whether MAA is added or not.

While a specific embodiment of the invention has been shown and described in detail to illustrate the application of the principles of the invention, it will be understood that the invention may be embodied otherwise without departing from such principles.

What is claimed is:

1. A flotation process for selectively recovering valuable metals while rejecting arsenide minerals from an ore containing both said valuable metals and arsenide minerals comprising the steps of:

wet-grinding the ore into a slurry, adjusting the pH of the slurry to a preset value by the addition of reagents, oxidizing the slurry by providing an oxidizing environment to the slurry, adding a reagent suite of a polyamine and a sulfur-containing species to the slurry for depressing flotation of arsenide minerals, readjusting the pH of the slurry to a the preset value by the addition of reagents, adding a collector and a frother at effective dosages to the slurry to float valuable minerals to be recovered and subjecting the slurry containing the collector and frother to flotation to float and selectively recover the valuable metal while rejecting the depressed arsenide minerals.

2. A process according to claim 1 wherein the preset value of the pH of the slurry is about 9.0 to 10.0.

3. A process according to claim 1 wherein the pH of the slurry is adjusted by the addition of lime.

4. A process according to claim 1 wherein the oxidizing environment is created by utilizing an oxidant selected from at least one of the group consisting of aeration, the addition of hydrogen peroxide, and the addition of permanganate ion.

5. A process according to claim 1, wherein said polyamine is selected from at least one of the group consisting of ethylene diamine, 1,3-diaminopropane, (2-aminoethyl)-2-aminoethanol, histidine, diethylenetetramine, triethylenetetramine, and any other polyethylenepolyamines in which the number of ethyleneamine units is equal to or greater than that in diethylenetriamine.

6. A process according to claim 1, wherein said sulfur containing species is selected from at least one of the group consisting of thiosulfate, sulfides, hydrosulfides, polysulfides, sulfites, metabisulfites, hydrosulfites, dithionates, tetrathionates, sulfur dioxide, and mixtures thereof, wherein a cationic part of said sulfur containing species consists of hydrogen, sodium, potassium, ammonium, calcium, and barium.

7. A process according to claim 1 wherein the polyamine and sulfur containing species are provided in a ratio ranging from about 1:1 to 1:8 and most preferably from about 1:1 to 1:4.

8. A process according to claim 1 wherein the collector is selected from at least one or more of the group consisting of xanthates, phosphine-based compounds, dithiophosphonates, alkyldiphosphates, thionocarbamates, thiourea or other conventional sulfhydryl collectors.

9. A process according to claim 1 wherein the frother is polypropylene glycol methyl ether.

10. A process according to claim 1 wherein the slurry contains about 20% to 45% solids by weight.

11. A process according to claim 1 wherein the slurry has a temperature between about 5° C. and 35° C.

12. A flotation process for selectively recovering high grade nickel and copper metal concentrates while rejecting arsenide minerals from nickel-copper ore comprising the steps of:

wet-grinding the nickel-copper ore into a slurry, adjusting the pH of the slurry to a preset value with the addition of reagents, oxidizing the slurry by providing an oxidizing environment to the slurry, adding a reagent suite of a polyamine and a sulfite to the slurry for depressing flotation of arsenide minerals, readjusting the pH of the slurry to the preset value with the addition of reagents and adding a collector and a frother at effective dosages to the slurry to float the nickel and copper metals to be recovered and subjecting the slurry containing the collector and frother to flotation to selectively recover high grade nickel and copper metal concentrates while rejecting the depressed arsenide minerals.

13. A process according to claim 12 wherein the slurry includes pentlandite, chalcopyrite, pyrrhotite, gersdorffite, cobaltite and niccolite and siliceous gangue minerals.

14. A process according to claim 12, wherein the arsenide minerals to be depressed are gersdorffite, niccolite and cobaltite.

15. A process according to claim 12 wherein the preset value of the pH of the slurry is about 9.0 to 10.0.

16. A process according to claim 12 wherein the pH of the slurry is adjusted by the addition of lime.

17. A process according to claim 12 wherein the oxidizing environment is created by utilizing an oxidant selected from at least one of the group consisting of aeration, the addition of hydrogen peroxide, and the addition of permanganate ions.

18. A process according to claim 12 wherein the reagent suite for depressing arsenide minerals is an effective ratio of triethylenetetramine to sodium sulfite.

19. A process according to claim 18 wherein the triethylenetetramine to sodium sulfite ratio is about 1:2 by weight.

20. A process according to claim 12 wherein potassium amyl xanthate is added as the collector.

21. A process according to claim 12 wherein the frother is a polypropylene glycol methyl ether.

22. A process according to claim 12 wherein an effective dosage of the collector is provided and determined by pentlandite, chalcopyrite and pyrrhotite content in the nickel-copper ore.

23. A process according to claim 12 wherein an effective dosage of the frother is provided to produce a Cu—Ni bulk concentrate of high grades at maximal copper and nickel recovery.

24. A process according to claim 12 wherein froth is generated by rising air bubbles through an introduction of air to the slurry.

25. A process according to claim 12 wherein the slurry contains about 40% solids by weight.

26. A process according to claim 12 wherein the slurry has a temperature between about 23° C.

* * * * *